US010799003B2

(12) United States Patent
Bradley et al.

(10) Patent No.: US 10,799,003 B2
(45) Date of Patent: Oct. 13, 2020

(54) CINCHABLE CARRYING BAG AND RELATED SYSTEMS AND METHODS

(71) Applicant: CAMPAK GEAR LLC, Lake Point, UT (US)

(72) Inventors: Christopher James Bradley, Lake Point, UT (US); Aimee Elizabeth Bradley, Lake Point, UT (US)

(73) Assignee: Campak Gear LLC, Lake Point, UT (US)

( * ) Notice: Subject to any disclaimer, the term of this patent is extended or adjusted under 35 U.S.C. 154(b) by 207 days.

(21) Appl. No.: 15/960,185

(22) Filed: Apr. 23, 2018

(65) Prior Publication Data

US 2018/0235335 A1 Aug. 23, 2018

Related U.S. Application Data

(63) Continuation-in-part of application No. 29/591,214, filed on Jan. 18, 2017, now Pat. No. Des. 815,832.

(51) Int. Cl.
*A45C 7/00* (2006.01)
*A45C 3/04* (2006.01)

(52) U.S. Cl.
CPC ..... *A45C 7/0077* (2013.01); *A45C 3/04* (2013.01); *A45C 7/00* (2013.01); *A45C 2007/0004* (2013.01)

(58) Field of Classification Search
CPC ..... A45C 7/0077; A45C 3/04; A45C 7/00; A45C 2007/0004
See application file for complete search history.

(56) References Cited

U.S. PATENT DOCUMENTS 4,810,102 A * 3/1989 Norton ..... A45C 1/04 150/108
5,439,153 A * 8/1995 Murdoch ..... A45C 13/002 150/159

(Continued)

OTHER PUBLICATIONS

Amazon.com: https://vwvw.amazon.com/OUTRY-Foldable-Travel-Duffle-Lightweight/dp/B01MXXQMHR, available on information and belief at least as early as Jan. 5, 2017.

(Continued)

*Primary Examiner* — Tri M Mai
(74) *Attorney, Agent, or Firm* — Workman Nyedgger

(57) ABSTRACT

Products, processes, and kits are provided for compressing, containing, and carrying goods, particularly soft goods. Cinchable carrying bags are reconfigurable between and open, substantially flat configuration and the present disclosure relates to cinchable carrying bags, cases, or luggage. In particular, present disclosure relates to portable, soft-sided or textile bags configured for reducing the volume or footprint of a load of goods, such as soft goods, contained therein. More specifically, the present disclosure relates to reconfigurable bag templates configured for receiving a load of goods while in an open or substantially flat configuration, wrapping around the load of goods into a folded configuration, reducing the volume or footprint of the goods in a cinched configuration, and securing or containing the cinched goods in a closed configuration. The present disclosure relates to cinchable carrying bags, cases, or luggage. In particular, present disclosure relates to portable, soft-sided or textile bags configured for reducing the volume or footprint of a load of goods, such as soft goods, contained therein. More specifically, the present disclosure relates to reconfigurable bag templates configured for receiving a load of goods while in an open or substantially flat configuration, wrapping around the load of goods into a folded configuration, reducing the volume or footprint of the goods in a cinched configuration, and securing or containing the cinched goods in a closed configuration.

11 Claims, 15 Drawing Sheets

(56) References Cited

U.S. PATENT DOCUMENTS

| | | | | |
|---|---|---|---|---|
| 5,452,476 | A * | 9/1995 | Jenks | A41D 3/00 2/108 |
| 5,730,529 | A | 3/1998 | Fritz | |
| 6,126,054 | A | 10/2000 | Riemer | |
| 7,083,331 | B2 | 8/2006 | Nykoluk | |
| D622,504 | S | 8/2010 | Lion | |
| D627,163 | S | 11/2010 | Kittrell | |
| D646,485 | S | 10/2011 | Mason | |
| D648,121 | S | 11/2011 | Dallmann | |
| 8,079,502 | B2 | 12/2011 | Montgomery | |
| D671,744 | S | 12/2012 | Lang | |
| D699,031 | S | 2/2014 | Clavette | |
| D720,537 | S | 1/2015 | Taller | |
| D732,821 | S | 6/2015 | Baron | |
| 9,427,055 | B2 | 8/2016 | Bullock | |
| D790,847 | S | 7/2017 | Tappeiner | |
| D815,832 | S | 4/2018 | Bradley et al. | |
| 2004/0123386 | A1 | 7/2004 | Higashi | |
| 2005/0249439 | A1 | 11/2005 | Penson | |
| 2006/0260046 | A1 | 11/2006 | Landay | |
| 2009/0127045 | A1 | 5/2009 | Williams | |

OTHER PUBLICATIONS

Overstock.com: https://www.overstock.com/Luggage-Bags/SwissGear-Sierre-II-30-inch-Rolling-Drop-Bottom-Duffel-Bag/9160433/product.html?refccid=GKTCNZZ4M4XYHZCINU54HVN4H4&searchidx=17, available on information and belief at least as early as Oct. 10, 2014.

Amazon.com: https://www.amazon.com/Cabin-Max-Palermo-Detachable-Toiletry/dp/B00KO32NOO/ ref=redir_mobile_desktop?_encoding=UTF8&psc=1&refRID=CKGB31E4KRY05XJQFCT6&ref_=gp_aw_ybh_a_10, available on information and belief at least as early as May 30, 2014.

Longway Leisure.com: http://www.longwayleisure.com.au/products/flex-bow-tents/model-6011-vx, available on information and belief at least as early as Mar. 28, 2016.

Overstock.com: https://www.overstock.com/Luggage-Bags/Everest-40-inch-600-Denier-Polyester-Cargo-Duffel-Bag/6026403/product.html?refccid=GKTCNZZ4M4XYHZCINU54HVN4H4&searchidx=8, available on information and belief at least as early as Aug. 13, 2011.

Moskomoto.com: https://moskomoto.com/products/reckless-40l-system, available on information and belief at least as early as Mar. 13, 2015.

Amazon, "Gobi Gear—Segsac Traveler . . . ", Accessed Nov. 015, 2017, for sale first on Jul. 12, 2012. (https://www.amazon.com/dp/B008KOZ648/).

BangGood, "BUBM Waterproof Storage Protective Case Roll Camera Bag for GoPro Hero . . . ", Accessed Nov. 15, 2017, First Review Dec. 20, 2016. (https://www.banggood.com/Waterproof-Storage-Protective-Case-Roll-Camera-Bag-for-GoPro-Hero433-SJ4000-p-1091588.html).

Kestrel Ballistics, "Full Spectrum Solutions Minimalist Shooting Mat", Accessed Nov. 15, 2017. (http://www.nkhome.com/ballisticsproducts/full-spectrum-solutions-minimalist-shooting-mat).

* cited by examiner

CINCHABLE CARRYING BAG AND RELATED SYSTEMS AND METHODS

CROSS-REFERENCE TO RELATED APPLICATIONS

This application is a Continuation-in-part of U.S. Design Application No. 29/591,214, filed Jan. 18, 2017, the entirety of which is incorporated herein by reference.

BACKGROUND

1. Technical Field

The present disclosure relates to cinchable carrying bags, cases, or luggage. In particular, present disclosure relates to portable, soft-sided or textile bags configured for reducing the volume or footprint of a load of goods, such as soft goods, contained therein. More specifically, the present disclosure relates to reconfigurable bag templates configured for receiving a load of goods while in an open or substantially flat configuration, wrapping around the load of goods into a folded configuration, reducing the volume or footprint of the goods in a cinched configuration, and securing or containing the cinched goods in a closed configuration.

2. Relevant Technology

Traditional carrying bag, e.g., duffel bags, backpacks, etc., are configured to receive items into an inner compartment of the bag through a zipper-closable opening. Sleeping bag stuff sacks and other carrying bags may include a draw string-closable opening. Inserting items into the inner compartment involves passing the items through the opening. Items larger than the opening may be stuffed into the compartment through the opening. Items larger than the inner compartment may be stuffed or compressed by force and then retained in compressed configuration by closing the opening. As the compressed items decompress or expand within the compartment, they place stress on the zipper or drawstring closing mechanism that may result in closure mechanism failure. Some items, such as large sleeping bags, may even need to be tightly rolled up and secured prior to being stuffed into the bag. Once contained in the bag, there are few if any efficient ways to further compress the items to reduce the size of the loaded bag.

Accordingly, there are a number of disadvantages in conventional carrying bags that can be addressed.

SUMMARY

The present disclosure relates to cinchable carrying bags, cases, or luggage. In particular, present disclosure relates to portable, soft-sided or textile bags configured for reducing the volume or footprint of a load of goods, such as soft goods, contained therein. More specifically, the present disclosure relates to reconfigurable bag templates configured for receiving a load of goods while in an open or substantially flat configuration, wrapping around the load of goods into a folded configuration, reducing the volume or footprint of the goods in a cinched configuration, and securing or containing the cinched goods in a closed configuration.

The cinchable carrying bag being configurable between an unfolded, loading configuration and a folded, storage configuration. The bags of the present disclosure can reduce the amount of time and effort it takes to pack soft goods (e.g., pillows, blankest, sleeping bags, towels, clothing, etc.)

and to shrink or reduce the space of those goods, as compared to using conventional bags. The bags of the present disclosure also reduce the footprint of the soft goods while better protecting them from becoming dirty.

The present invention also relates to a bag assembly. The bag assembly can comprise a flexible bag template. The template can comprise, for example, a (rectangular-shaped) storage element, optionally formed of a textile material, the storage element optionally comprising a storage panel, a wrapping panel (extending from a first side of the storage panel), and/or an anchor panel (extending from an opposing second side of the storage panel). The storage element can optionally have: an upper edge; a lower edge (opposite the upper edge); a first side edge (extending between the upper edge and the lower edge (e.g., on a first side of the storage element)); an opposing second side edge (extending between the upper edge and the lower edge (e.g., on a second side of the storage element opposite the first side)); an inner surface (comprising an inner face of the wrapping panel, an inner face of the storage panel, and/or an inner face of the anchor panel); and/or an outer surface (opposite the inner surface), the outer surface optionally comprising an outer face of the wrapping panel, an outer face of the storage panel, and an outer face of the anchor panel The template can also comprise a first connecting element (attached to the outer surface of the wrapping panel) and/or a second connecting element (attached to the outer surface of the anchor panel), the second connecting element and the first connecting element optionally being configured for mating to each other, one or more of the first connecting element and the second connecting element optionally comprising a first cinching element configured to reduce a distance between a portion of the wrapping panel and a portion of the anchor panel when the first connecting element and the second connecting element are mated to each other.

The template can also comprise a hood element (extending from an upper edge of the storage panel). The hood element can have: a lower edge (connected to the upper edge of the storage panel); an upper edge (opposite the lower edge); a first elastic side edge (extending between the upper edge of the hood element and the lower edge of the hood element (e.g., on a first side of the hood element)); an (opposing) second elastic side edge (extending between the upper edge of the hood element and the lower edge of the hood element (e.g., on a second side of the storage element opposite the first side)); a third connecting element (attached to the storage panel); and a fourth connecting element (attached to the hood element), the fourth connecting element and the first connecting element optionally being configured for mating to each other, one or more of the third connecting element and the fourth connecting element optionally comprising a second cinching element configured to reduce a distance between a portion of the storage panel and a portion of the hood element when the third connecting element and the fourth connecting element are mated to each other.

In some embodiments, the bag template can be reconfigurable between: an unfolded configuration (in which the storage element is disposed in a substantially flat configuration); and a folded configuration (in which: the storage element is wrapped and optionally cinched around the load of goods, with the first connecting member being connected to the second connecting member; and/or the hood element envelopes a portion of the wrapped and optionally cinched storage element, with the third connecting member being connected to the second connecting member.

In some embodiments, a center line of the storage element extending between the upper edge and the lower edge of the storage element equidistant between the first side edge and second side edge of the storage element is separated by a first distance from a center line of the storage panel extending between the upper edge and the lower edge of the storage panel equidistant between the first side and second side of the storage panel.

In some embodiments the first distance is at least 5% of a length between the first side edge of the storage element and the second side edge of the storage element.

In some embodiments a first boundary line extending between the upper edge of the storage element adjacent to the first elastic side edge of the hood element and the lower edge of the storage element defines the first side of the storage panel and a boundary line extending between the upper edge of the storage element adjacent to the second elastic side edge of the hood element and the lower edge of the storage element defines the second side of the storage panel.

Some embodiments further comprise a first elastic element attached to the hood element to form the first elastic side edge and a second elastic element attached to the hood element to form the second elastic side edge.

Some embodiments further comprise a carrying handle connected to the bag template, the handle forming a loop configured for hand-carrying the bag template in the folded configuration.

In some embodiments the carrying handle is attached to an outer surface of the hood element.

In some embodiments the carrying handle is attached to an outer surface of the storage element.

Some embodiments further comprise a carrying strap connectable to the bag template.

Some embodiments further comprise a pocket connected to an outer surface of the hood element and/or the outer surface of the storage element.

Some embodiments further comprise a pocket connected to the inner surface of the storage element.

Some embodiments further comprise a plurality of pockets connected to the inner surface of the storage element.

The present invention also relates to a cinchable carrying bag, comprising (1) a flexible, flaccid, fabric, and/or textile bag element, optionally comprising (i) a product receiving member and (ii) a covering member; and (2) a cinching element.

In some embodiments, the bag starts out being able to lay out flat in the open position and allows the user to place the goods on the footprint of the bag and use the buckles and straps to cinch down the size of the payload. And then with the "over flap", envelop the payload to protect against outside elements. It has a carrying handle as well as a shoulder strap for easy of transporting the bag.

Without being bound to any theory, existing "cinch" bags are limited to what most refer to as stuff sacks. Most cinch or compression bags, they are limited to the user stuffing goods into them but once in, the goods still try to expand back to their original size thus making the process cumbersome and inefficient. The present disclosure involves cinching through the use of the pull straps compressing the goods down. This also eliminates the hassle of the user having to stuff soft goods into a bag. The pressure points where the straps are sewn allow as much compression as possible. The offset "T" shape contributes to cinching ability, in some embodiments.

Additional features and advantages of exemplary embodiments of the present disclosure will be set forth in the description which follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description and appended claims, or may be learned by the practice of such exemplary embodiments as set forth hereinafter.

BRIEF DESCRIPTION OF THE DRAWINGS

In order to describe the manner in which the above-recited and other advantages and features of the present disclosure can be obtained, a more particular description of the embodiments briefly described above will be rendered by reference to specific embodiments thereof which are illustrated in the appended drawings. For better understanding, the like elements have been designated by like reference numbers throughout the figure(s). Understanding that these drawings depict only typical embodiments of the invention and are not therefore to be considered to be limiting of its scope, the invention will be described and explained with additional specificity and detail through the use of the accompanying drawing(s) in which.

DETAILED DESCRIPTION

Figure 1A:
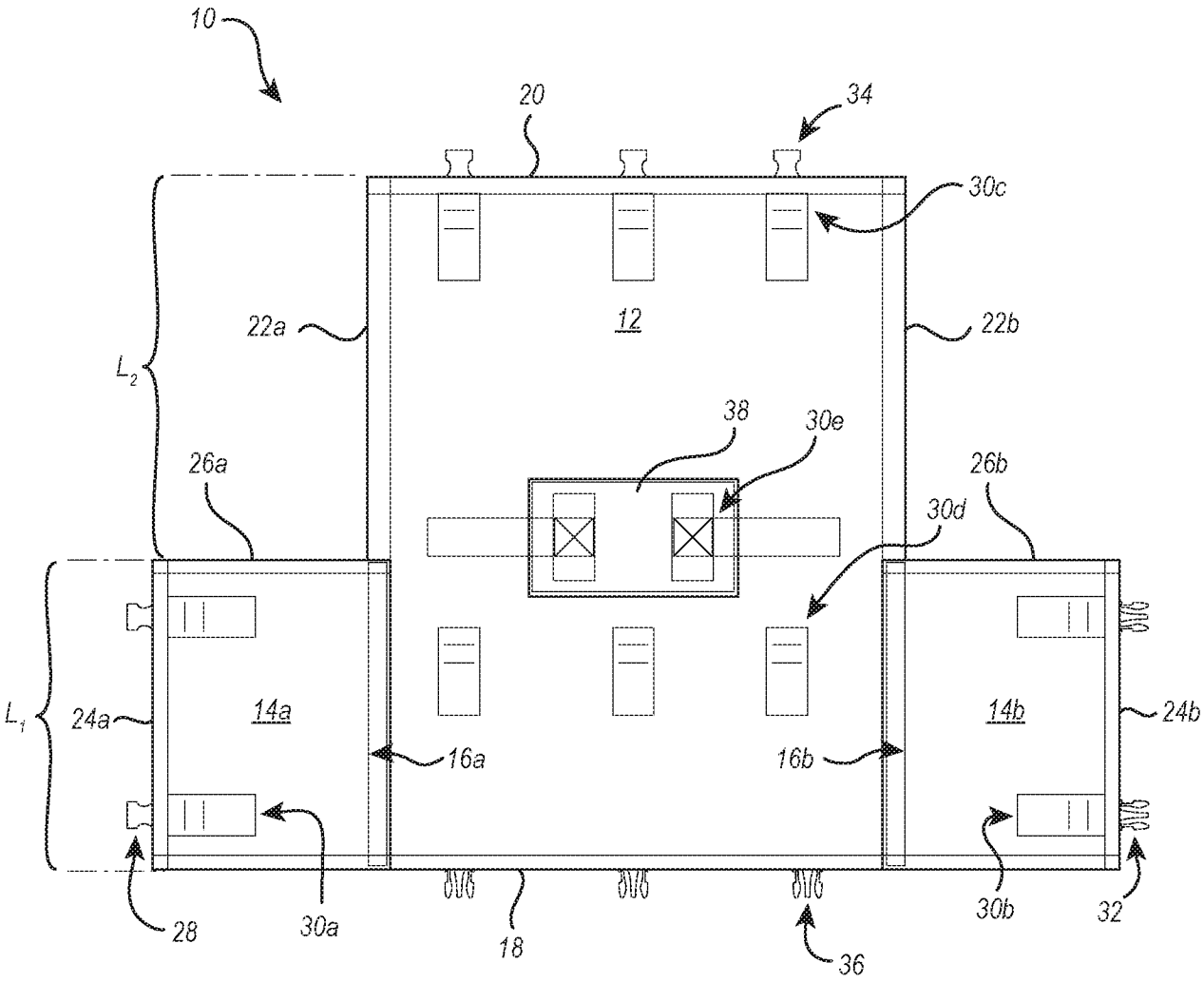
FIG. 1A is a top plan view of a product wrap in an unfolded configuration according to an embodiment of the present disclosure.
Figure 1B:
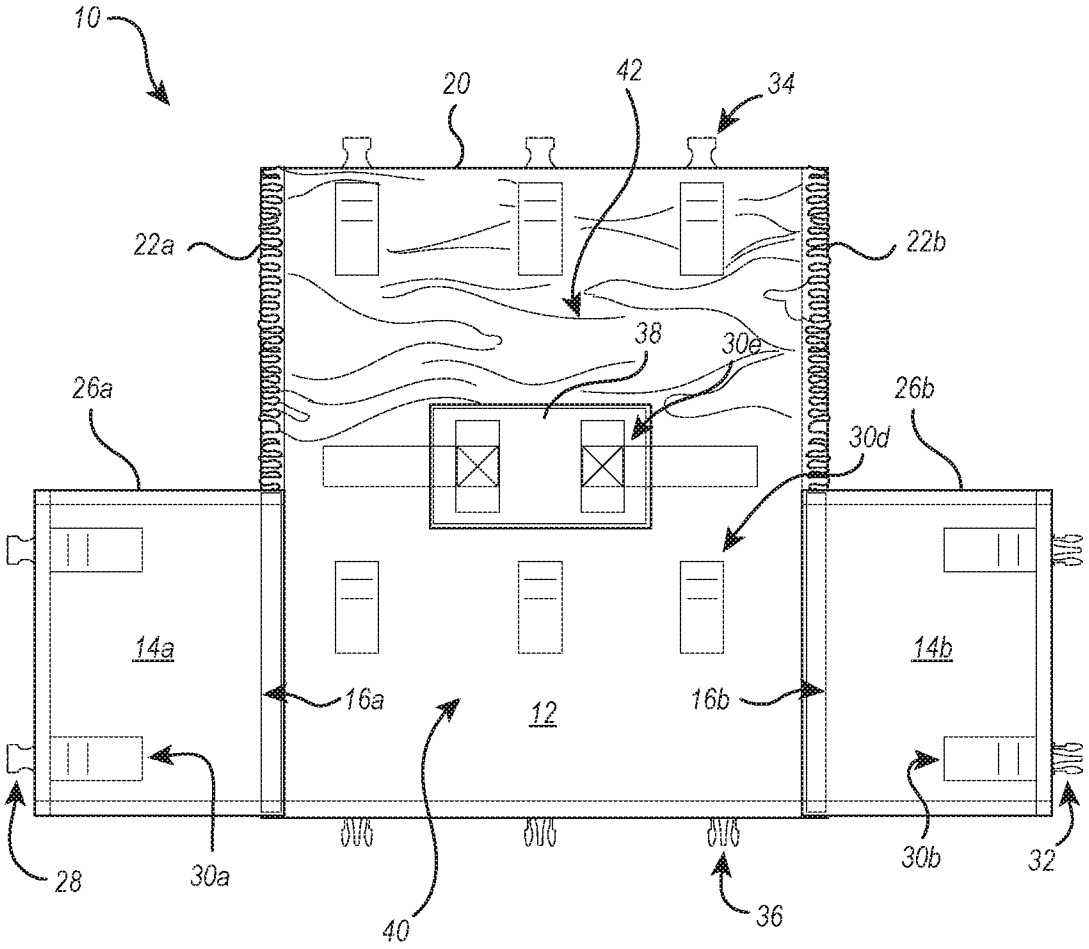
FIG. 1B is a top plan view thereof in a partially disassembled configuration.
Figure 2A:
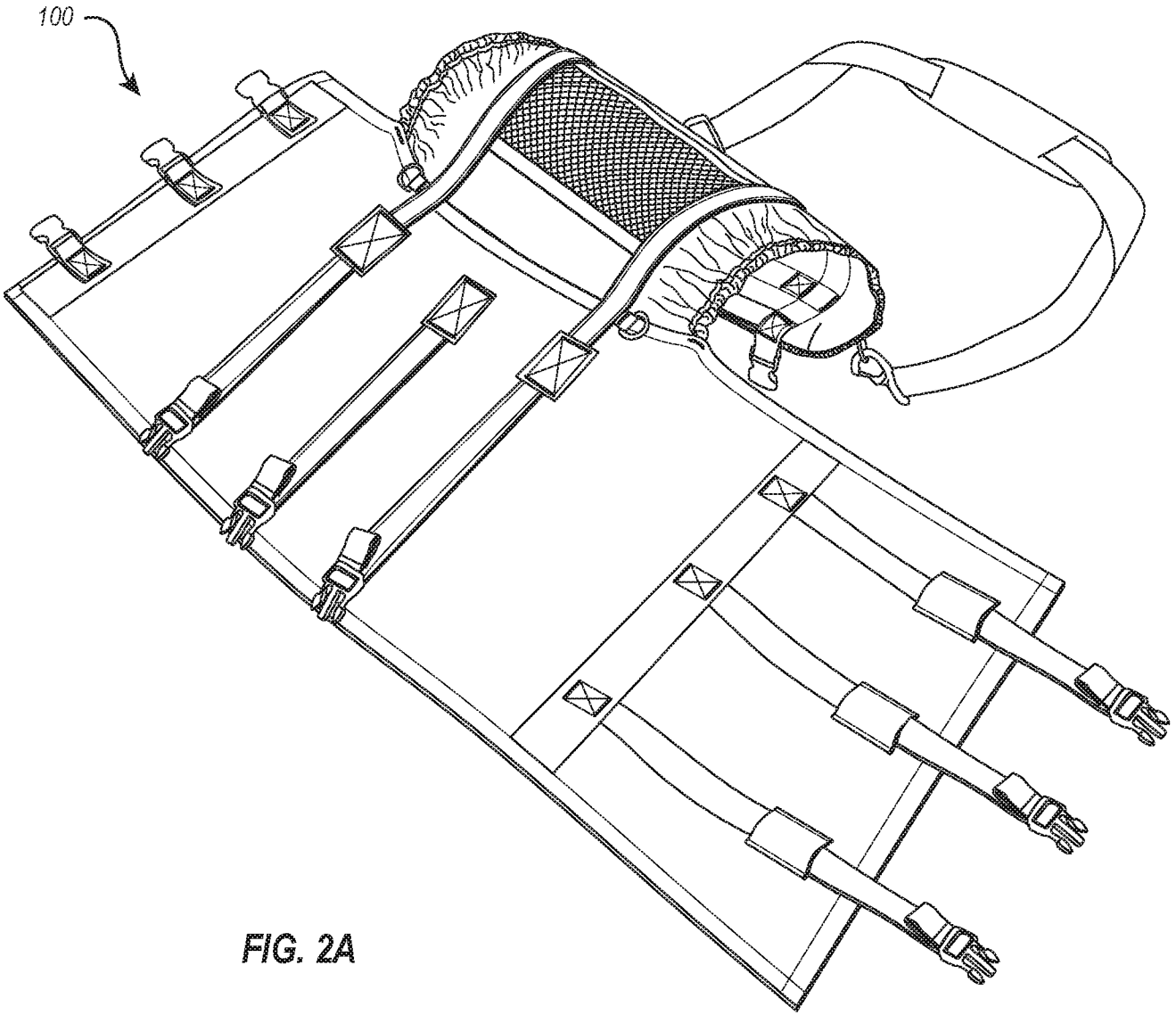
FIG. 2A is a bottom perspective view of a cinchable carrying bag in an unfolded configuration.
Figure 2B:
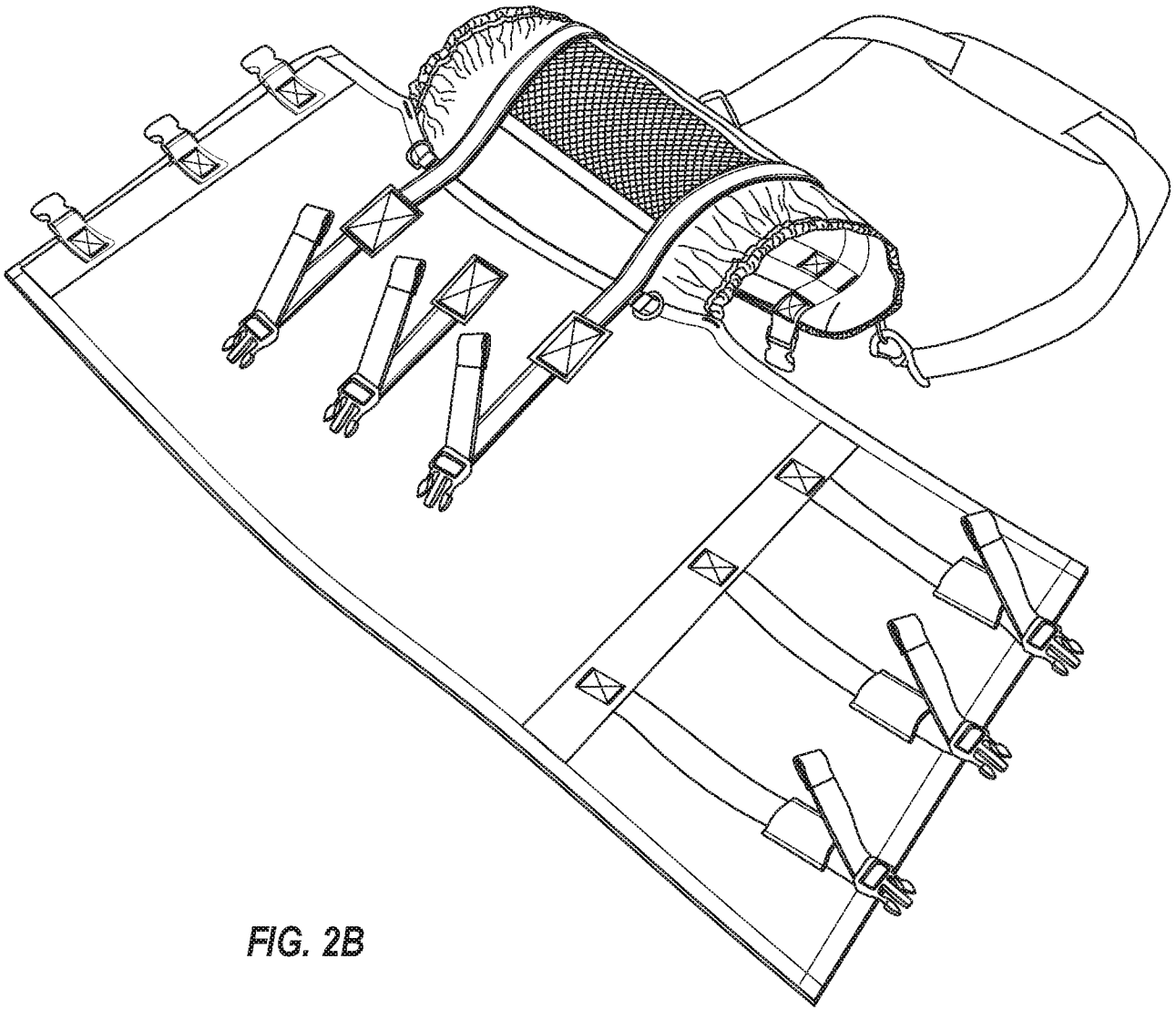
FIG. 2B is a bottom perspective view thereof in another unfolded configuration.
Figure 2C:
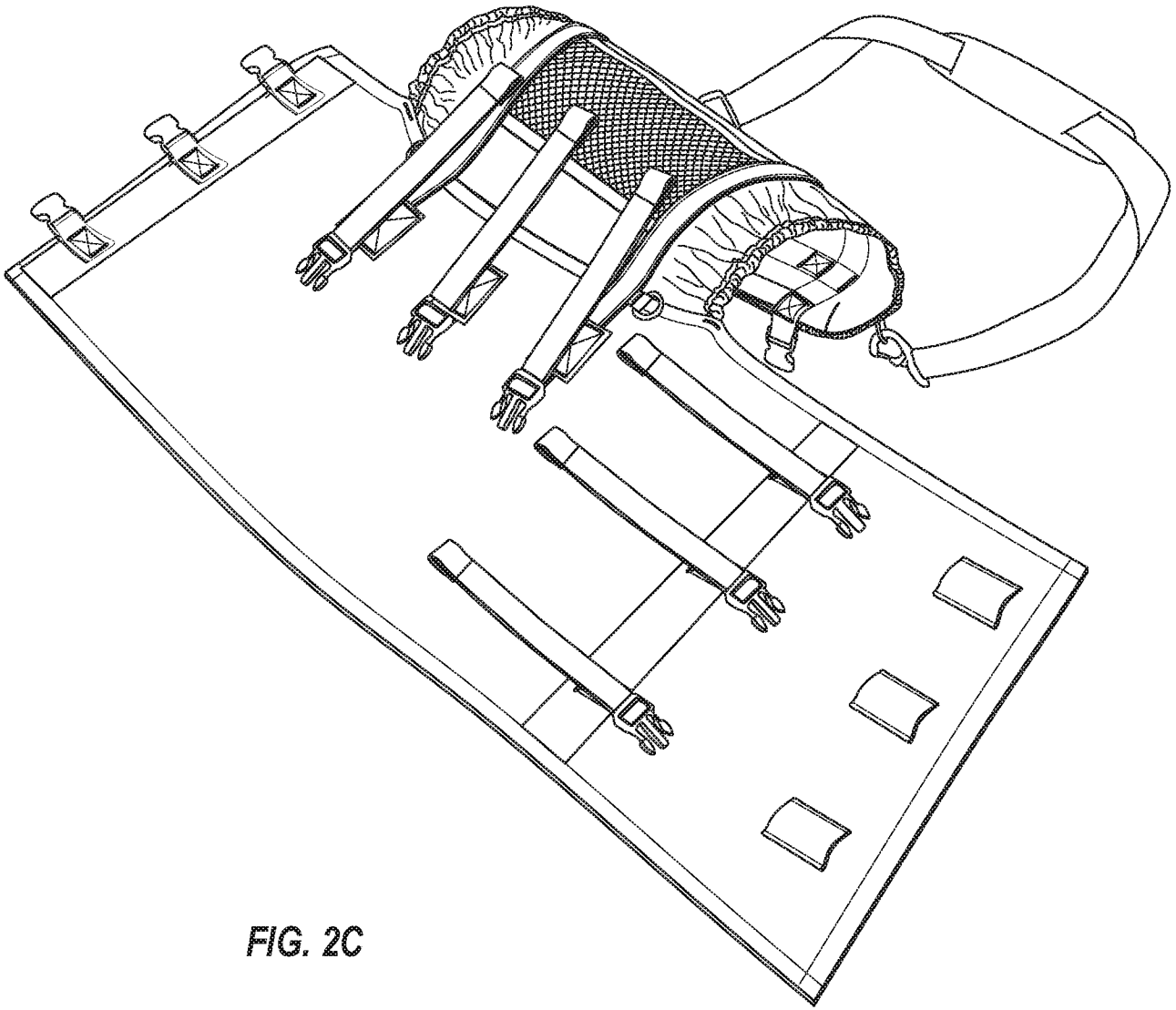
FIG. 2C is a bottom perspective view thereof in yet another unfolded configuration.
Figure 3:
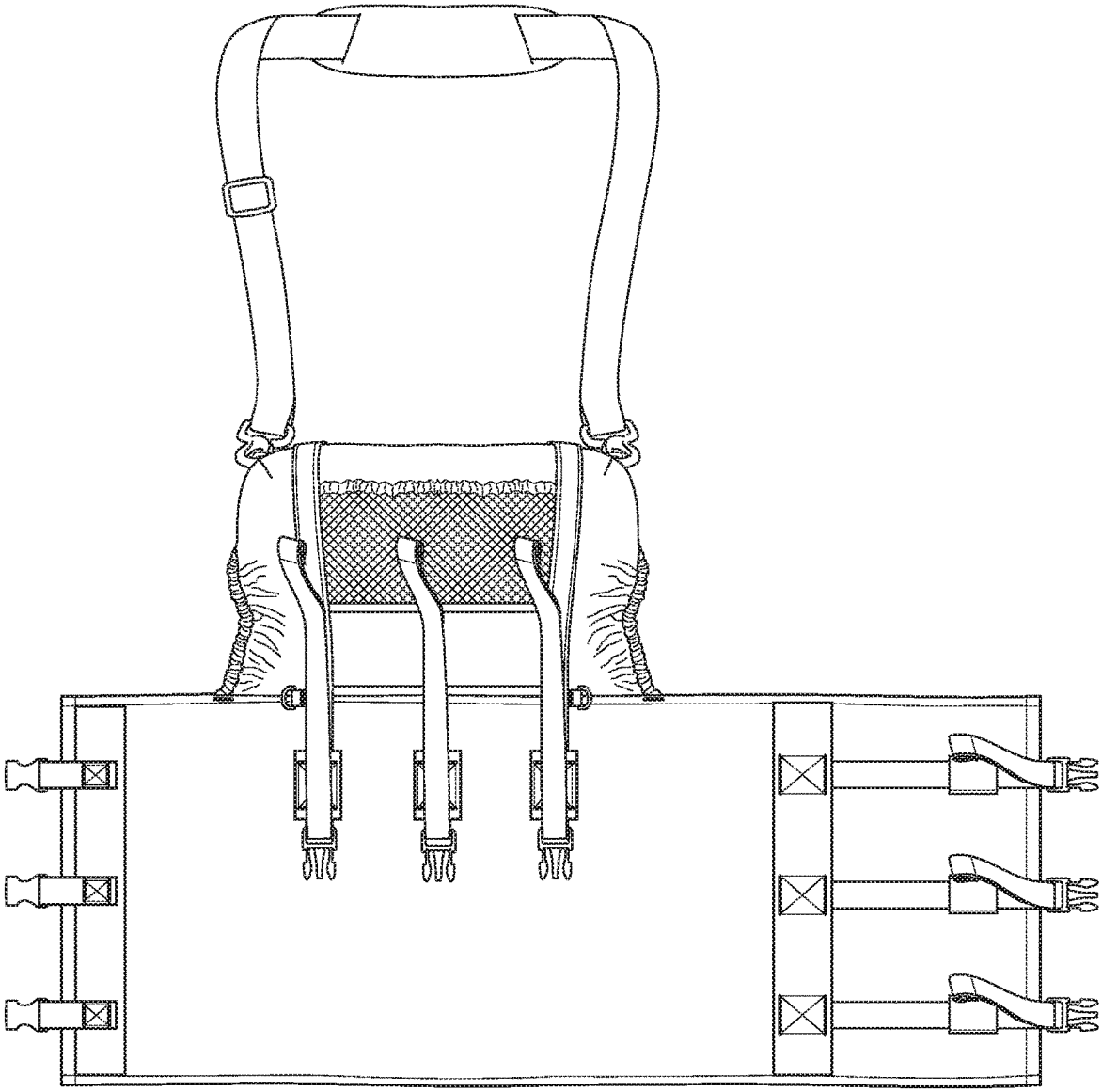
FIG. 3 is a bottom plan view thereof in still another unfolded configuration.
Figure 4:
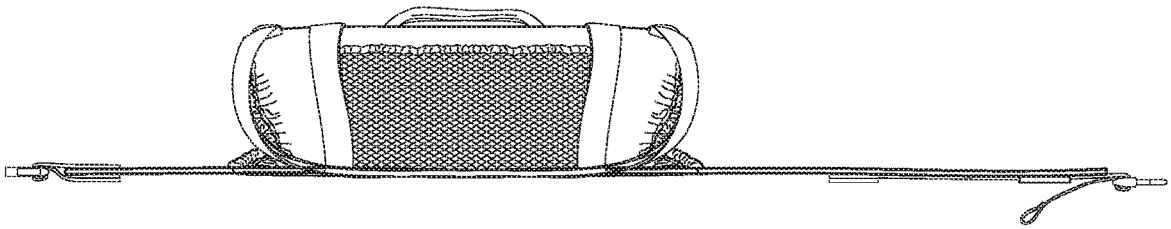
FIG. 4 is a rear elevation view thereof.
Figure 5:
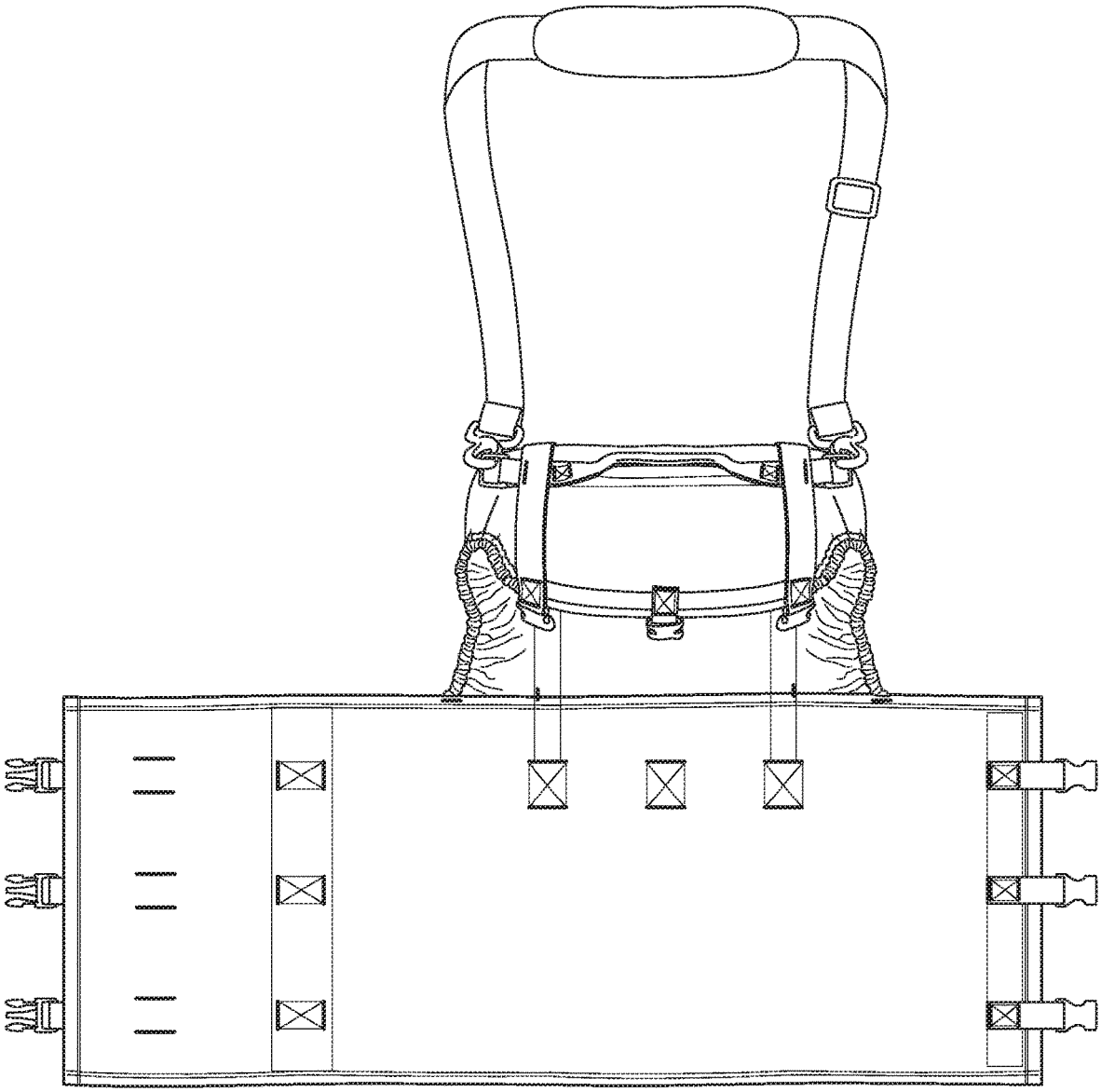
FIG. 5 is a top plan view thereof.
Figure 6:
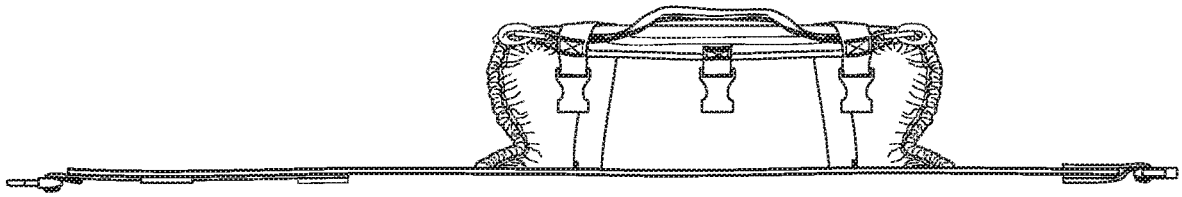
FIG. 6 is a front elevation view thereof.
Figure 7:
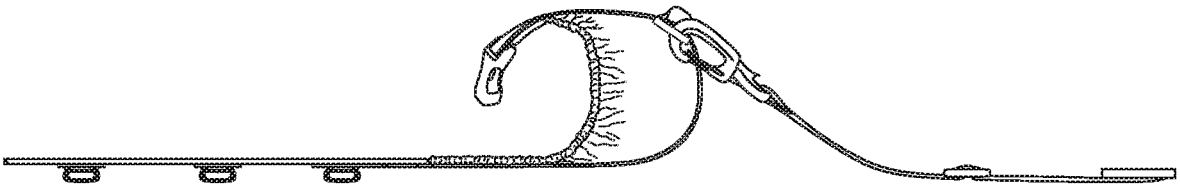
FIG. 7 is a right side elevation view thereof.
Figure 8:
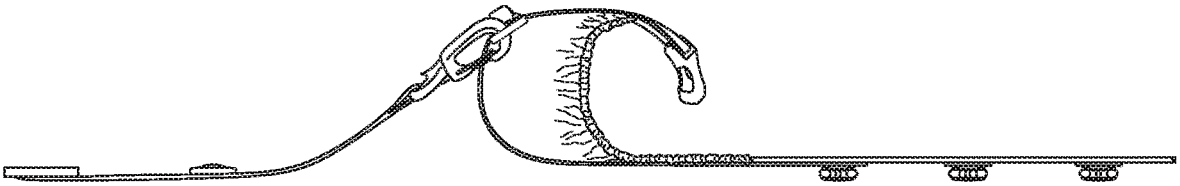
FIG. 8 is a left side elevation view thereof.
Figure 9:
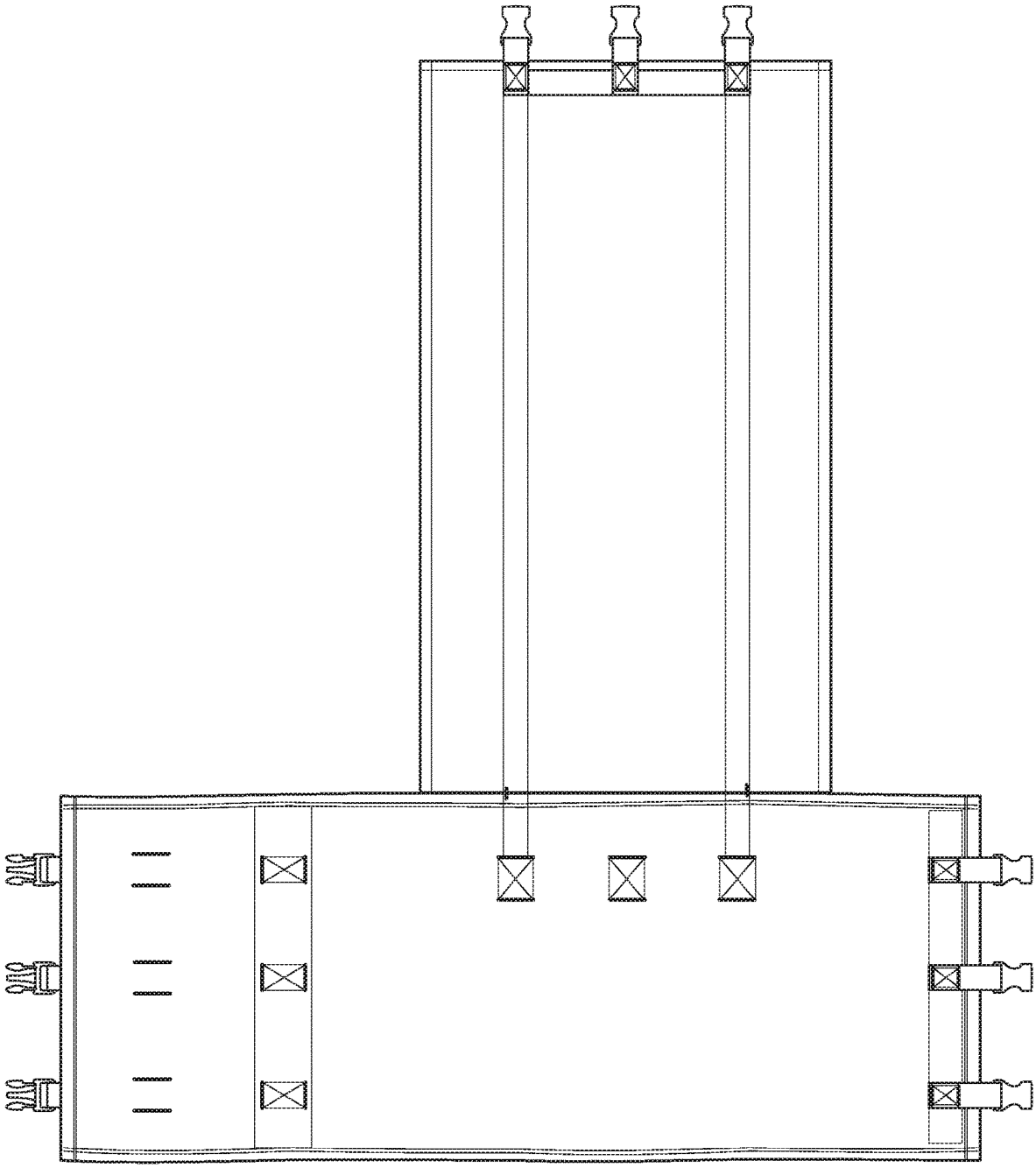
FIG. 9 is a top plan view thereof in a partially disassembled configuration.
Figure 10A:
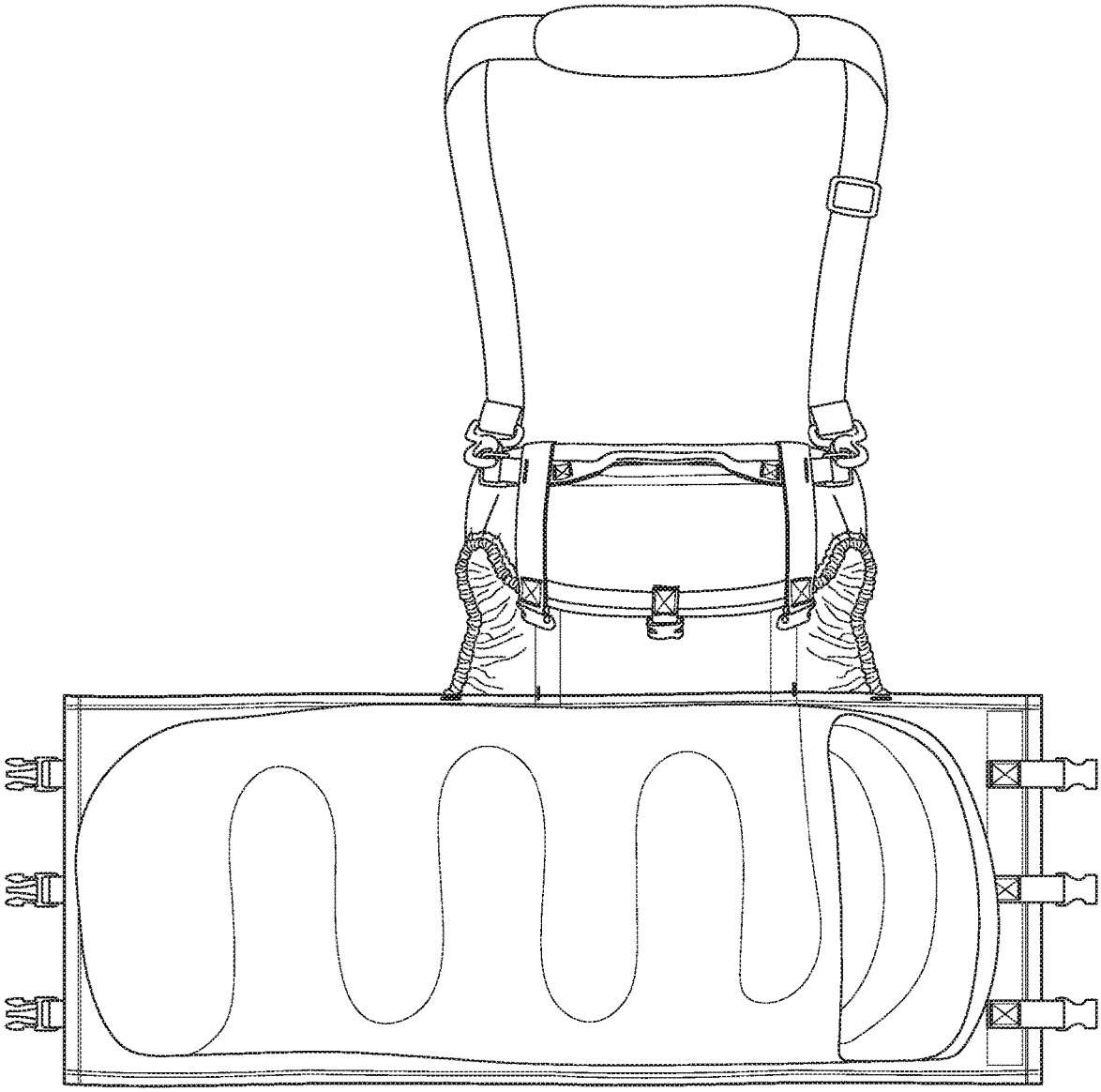
FIG. 10A is a top plan view thereof in a product use environment.
Figure 10B:
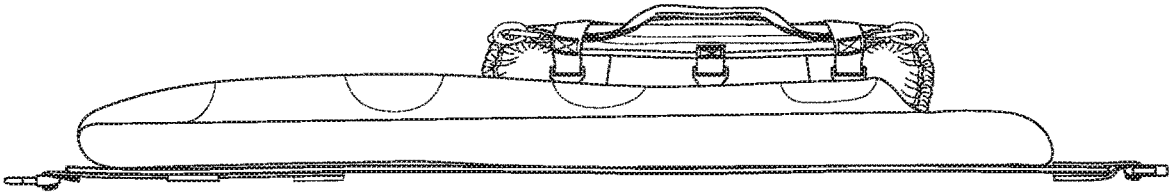
FIG. 10B is a front elevation view thereof.
Figure 11A:
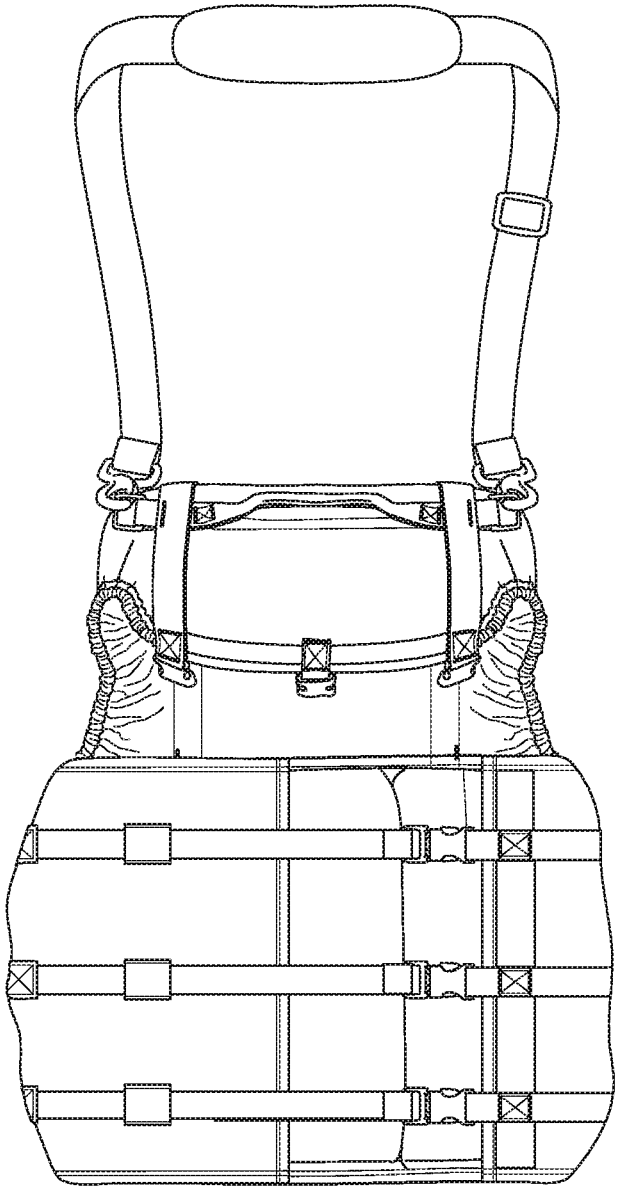
FIG. 11A is a top plan view thereof in a partially folded configuration.
Figure 11B:
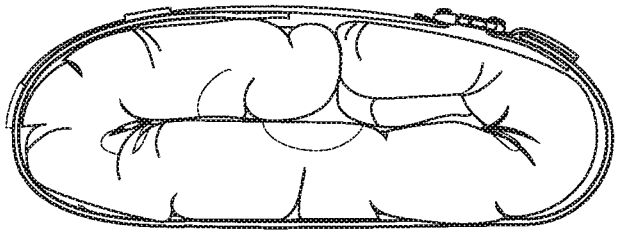
FIG. 11B is a front elevation view thereof.
Figure 12A:
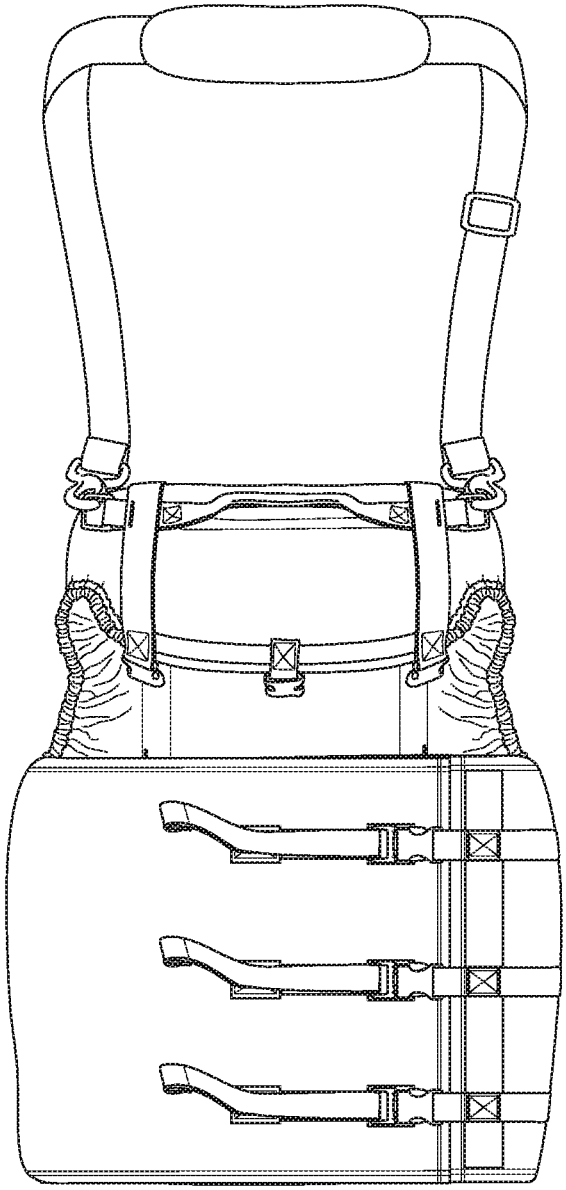
FIG. 12A is a top plan view thereof in a partially folded, partially cinched configuration.
Figure 12B:
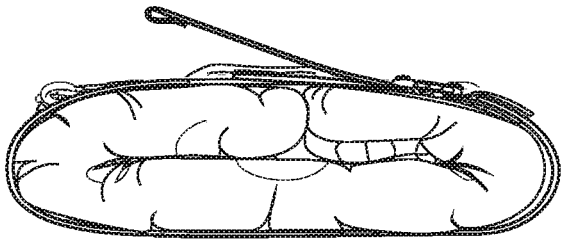
FIG. 12B is a front elevation view thereof.
Figure 13A:
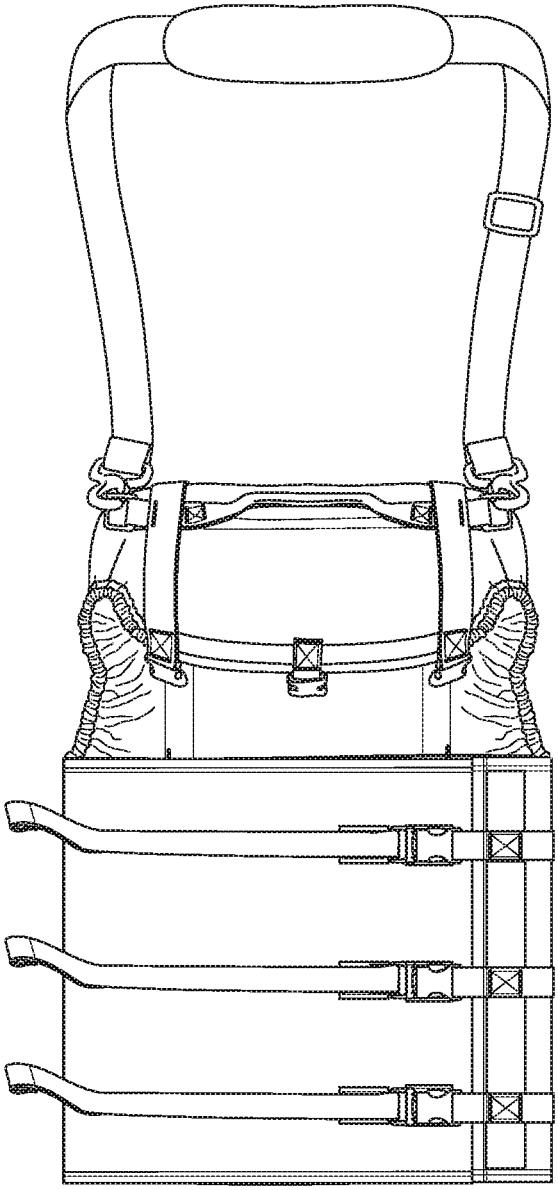
FIG. 13A is a top plan view thereof in a partially folded, fully cinched configuration.
Figure 13B:
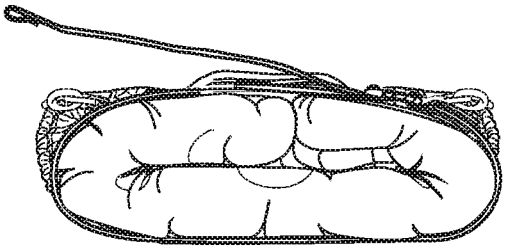
FIG. 13B is a front elevation view thereof.
Figure 14A:
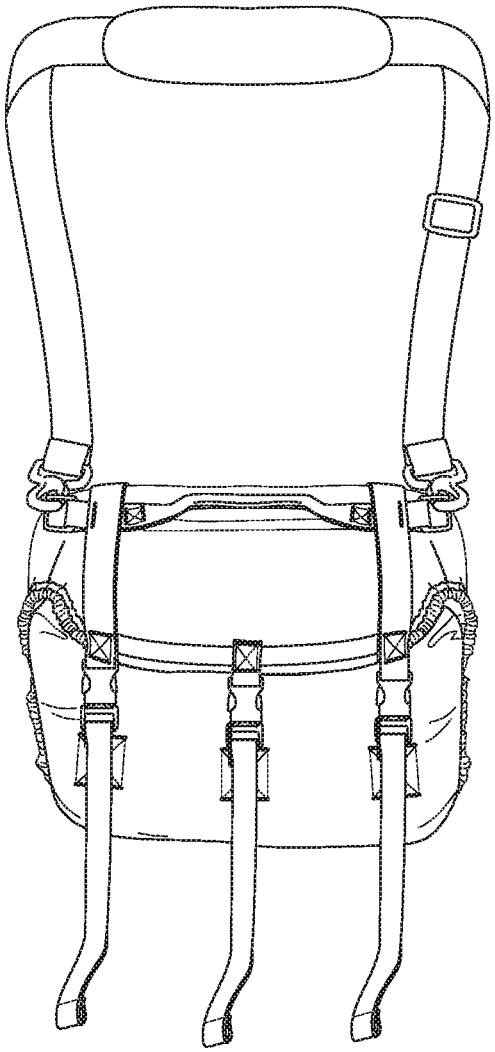
FIG. 14A is a front elevation view thereof in a fully folded, fully cinched configuration.
Figure 14B:
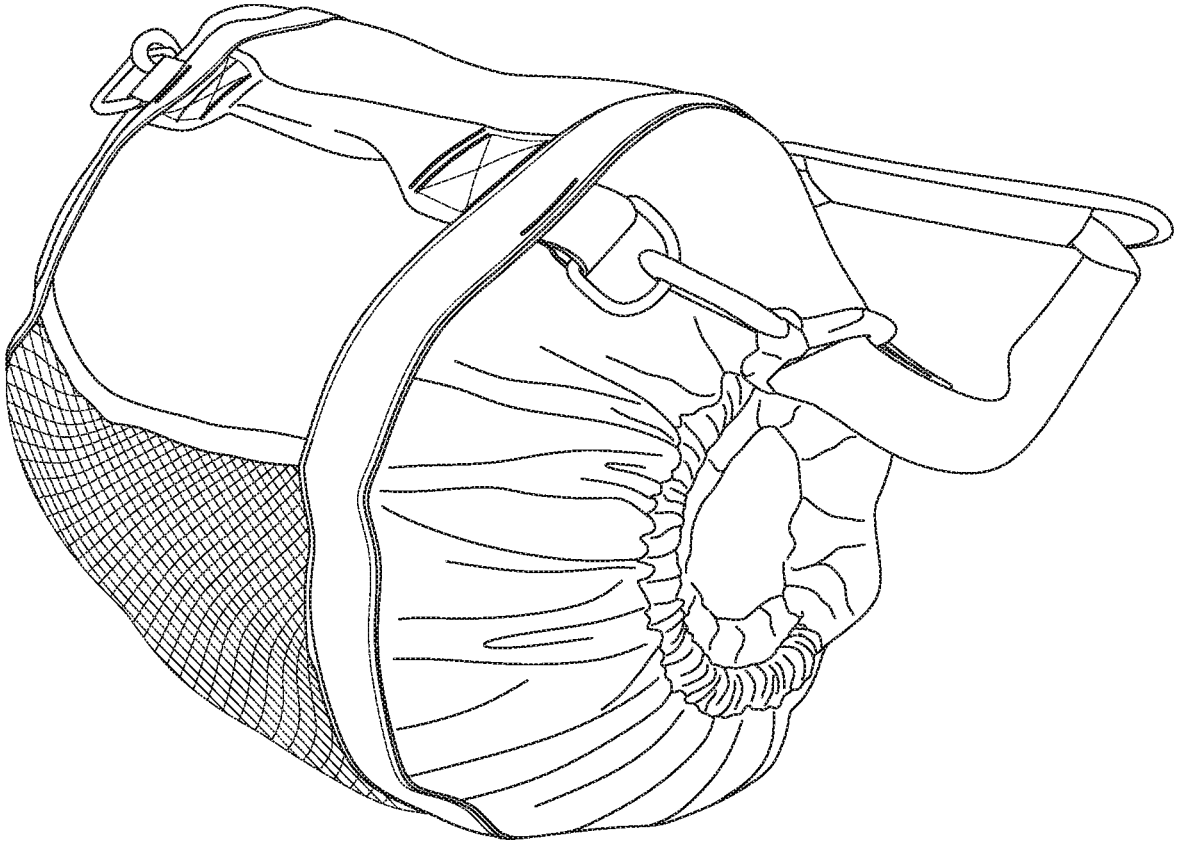
FIG. 14B is a perspective view thereof.

Before describing the present disclosure in detail, it is to be understood that this disclosure is not limited to parameters of the particularly exemplified products, systems, kits, and/or methods, which may, of course, vary from one embodiment or implementation to the next. It is also to be understood that the terminology used herein is only for the purpose of describing particular embodiments of the present invention, and is not intended to limit the scope of the invention in any manner.

The terms "including," "having," "involving," "containing," "characterized by," and variants thereof (e.g., "includes," "has," and "involves," "contains," etc.) as used herein, including the claims, shall be inclusive and/or open ended, shall have the same meaning as the word "comprising" and variants thereof (e.g., "comprise" and "comprises"), and does not exclude additional, unrecited elements or method steps, illustratively.

As used herein, the transitional phrase "consisting essentially of" means that the scope of a claim is to be interpreted to encompass the specified materials or steps recited in the claim, "and those that do not materially affect the basic and novel characteristic(s)" of the claimed invention. See, In re Herz, 537 F.2d 549, 551-52, 190 U.S.P.Q. 461, 463 (CCPA 1976) (emphasis in the original); see also MPEP § 2111.03. Thus, the term "consisting essentially of" when used in a claim of this disclosure is not intended to be interpreted to be equivalent to "comprising."

Various aspects of the present disclosure, including systems, methods, and/or products may be illustrated with reference to one or more embodiments or implementations, which are exemplary in nature. As used herein, the terms "embodiment" and "implementation" mean "serving as an example, instance, or illustration," and should not necessarily be construed as preferred or advantageous over other aspects disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the description thereof.

As used throughout this disclosure, the words "can" and "may" are used in a permissive sense (i.e., meaning having the potential to), rather than the mandatory sense (i.e., meaning must). Additionally, the terms "including," "having," "involving," "containing," "characterized by," variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

The word "or" as used herein means any one member of a particular list and also includes any combination of members of that list.

As used in this specification and the appended claims, the singular forms "a," "an" and "the" each contemplate, include, and specifically disclose both the singular and plural referents, unless the context clearly dictates otherwise. For example, reference to a "cinch straps" contemplates and specifically discloses one, as well as two or more cinch straps. Similarly, use of a plural referent does not necessarily require a plurality of such referents, but contemplates, includes, and specifically discloses one, as well as two or more of such referents, unless the context clearly dictates otherwise.

It is noted that embodiments of the present disclosure can comprise one or more combinations of two or more of the features described herein. As used herein, "feature(s)" and similar terms can include, for example, components, elements, members, parts, portions, systems, methods, (method) step, configurations, parameters, properties, or other aspect of the subject matter at hand. Embodiments can include any of the features, options, and/or possibilities set out elsewhere in the present disclosure, including in other aspects or embodiments of the present disclosure. It is also noted that each of the foregoing, following, and/or other features described herein represents a distinct embodiment of the present disclosure. Features can also be combined and/or combinable with another one or more other features in any suitable combination and/or order, with or without one or more additional features included therewith or performed therebetween, to form unique embodiments, each of which is contemplated in the present disclosure. Such combinations of any two or more of such features represent distinct embodiments of the present disclosure. Accordingly, the present disclosure is not limited to the specific combinations of exemplary embodiments described in detail herein and disclosure of certain features relative to a specific embodiment of the present disclosure should not be construed as limiting application or inclusion of said features to the specific embodiment.

In addition, unless a feature is described as being requiring in a particular embodiment, features described in the various embodiments can be optional and may not be included in other embodiments of the present disclosure. Moreover, unless a feature is described as requiring another feature in combination therewith, any feature herein may be combined with any other feature of a same or different embodiment disclosed herein. Likewise, any steps recited in any method described herein and/or recited in the claims can be executed in any suitable order and are not necessarily limited to the order described and/or recited, unless otherwise stated (explicitly or implicitly). Such steps can, however, also be required to be performed in a particular order in certain embodiments of the present disclosure.

It will also be appreciated that where a range of values (e.g., less than, greater than, at least, or up to a certain value, or between two recited values) is disclosed or recited, any specific value or range of values falling within the disclosed range of values is likewise disclosed and contemplated herein. Thus, disclosure of a length between about 12 inches and about 24 inches includes, illustratively, a specific disclosure of: (i) a length of about 12, 14, 16, 18, 20, 22, or 24 inches, or any other specific length between 12 inches and 24 inches; and/or (ii) a length between about 12 inches and about 18 inches, a length between about 16 inches and about 20 inches, a length between about 18 inches and about 24 inches, and/or any other range of values between a length between 12 inches and 24 inches.

As used herein, the term "about," with regard to a value, means +/−10% of the stated value or amount represented thereby. For instance, throughout the present disclosure, the term "about" is used in connection with a length of measurement. Alternatives for so-called "about" values and/or +/−10% include +/−1%, +/−2%, +/−3%, +/−4%, +/−5%, +/−6%, +/−7%, +/−8%, or +/−9% of the stated value, each of which is contemplated as a suitable alternative to or substitute for the term "about" or the use of +/−10% herein.

Unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only preferred materials and methods are described herein.

To facilitate understanding, like references (i.e., like naming of components and/or elements) have been used, where possible, to designate like elements common to different embodiments of the present disclosure. Similarly, like components, or components with like functions, will be provided with similar reference designations, where possible. Specific language will be used herein to describe the exemplary embodiments. Nevertheless it will be understood that no limitation of the scope of the disclosure is thereby intended. Rather, it is to be understood that the language used to describe the exemplary embodiments is illustrative only and is not to be construed as limiting the scope of the disclosure (unless such language is expressly described herein as essential).

The present disclosure relates to cinchable carrying bags, cases, or luggage. In particular, present disclosure relates to portable, soft-sided or textile bags configured for reducing the volume or footprint of a load of goods, such as soft goods, contained therein. More specifically, the present disclosure relates to reconfigurable bag templates configured for receiving a load of goods while in an open or substantially flat configuration, wrapping around the load of goods into a folded configuration, reducing the volume or footprint of the goods in a cinched configuration, and securing or containing the cinched goods in a closed configuration.

The cinchable carrying bag being configurable between an unfolded, loading configuration and a folded, storage configuration. The bags of the present disclosure can reduce the amount of time and effort it takes to pack soft goods (e.g., pillows, blankest, sleeping bags, towels, clothing, etc.) and to shrink or reduce the space of those goods, as compared to using conventional bags. The bags of the present disclosure also reduce the footprint of the soft goods while better protecting them from becoming dirty.

The present invention also relates to a bag assembly. The bag assembly can comprise a flexible bag template. The template can comprise, for example, a (rectangular-shaped) storage element, optionally formed of a textile material, the storage element optionally comprising a storage panel, a wrapping panel (extending from a first side of the storage panel), and/or an anchor panel (extending from an opposing second side of the storage panel). The storage element can optionally have: an upper edge; a lower edge (opposite the upper edge); a first side edge (extending between the upper edge and the lower edge (e.g., on a first side of the storage element)); an opposing second side edge (extending between the upper edge and the lower edge (e.g., on a second side of the storage element opposite the first side)); an inner surface (comprising an inner face of the wrapping panel, an inner face of the storage panel, and/or an inner face of the anchor panel); and/or an outer surface (opposite the inner surface), the outer surface optionally comprising an outer face of the wrapping panel, an outer face of the storage panel, and an outer face of the anchor panel The template can also comprise a first connecting element (attached to the outer surface of the wrapping panel) and/or a second connecting element (attached to the outer surface of the anchor panel), the second connecting element and the first connecting element optionally being configured for mating to each other, one or more of the first connecting element and the second connecting element optionally comprising a first cinching element configured to reduce a distance between a portion of the wrapping panel and a portion of the anchor panel when the first connecting element and the second connecting element are mated to each other.

The template can also comprise a hood element (extending from an upper edge of the storage panel). The hood element can have: a lower edge (connected to the upper edge of the storage panel); an upper edge (opposite the lower edge); a first elastic side edge (extending between the upper edge of the hood element and the lower edge of the hood element (e.g., on a first side of the hood element)); an (opposing) second elastic side edge (extending between the upper edge of the hood element and the lower edge of the hood element (e.g., on a second side of the storage element opposite the first side)); a third connecting element (attached to the storage panel); and a fourth connecting element (attached to the hood element), the fourth connecting element and the first connecting element optionally being configured for mating to each other, one or more of the third connecting element and the fourth connecting element optionally comprising a second cinching element configured to reduce a distance between a portion of the storage panel and a portion of the hood element when the third connecting element and the fourth connecting element are mated to each other.

In some embodiments, the bag template can be reconfigurable between: an unfolded configuration (in which the storage element is disposed in a substantially flat configuration); and a folded configuration (in which: the storage element is wrapped and optionally cinched around the load of goods, with the first connecting member being connected to the second connecting member; and/or the hood element envelopes a portion of the wrapped and optionally cinched storage element, with the third connecting member being connected to the second connecting member.

In some embodiments, a center line of the storage element extending between the upper edge and the lower edge of the storage element equidistant between the first side edge and second side edge of the storage element is separated by a first distance from a center line of the storage panel extending between the upper edge and the lower edge of the storage panel equidistant between the first side and second side of the storage panel.

In some embodiments the first distance is at least 5% of a length between the first side edge of the storage element and the second side edge of the storage element.

In some embodiments a first boundary line extending between the upper edge of the storage element adjacent to the first elastic side edge of the hood element and the lower edge of the storage element defines the first side of the storage panel and a boundary line extending between the upper edge of the storage element adjacent to the second elastic side edge of the hood element and the lower edge of the storage element defines the second side of the storage panel.

Some embodiments further comprise a first elastic element attached to the hood element to form the first elastic side edge and a second elastic element attached to the hood element to form the second elastic side edge.

Some embodiments further comprise a carrying handle connected to the bag template, the handle forming a loop configured for hand-carrying the bag template in the folded configuration.

In some embodiments the carrying handle is attached to an outer surface of the hood element.

In some embodiments the carrying handle is attached to an outer surface of the storage element.

Some embodiments further comprise a carrying strap connectable to the bag template.

Some embodiments further comprise a pocket connected to an outer surface of the hood element and/or the outer surface of the storage element.

Some embodiments further comprise a pocket connected to the inner surface of the storage element.

Some embodiments further comprise a plurality of pockets connected to the inner surface of the storage element.

The present invention also relates to a cinchable carrying bag, comprising (1) a flexible, flaccid, fabric, and/or textile bag element, optionally comprising (i) a product receiving member and (ii) a covering member; and (2) a cinching element.

In some embodiments, the bag starts out being able to lay out flat in the open position and allows the user to place the goods on the footprint of the bag and use the buckles and straps to cinch down the size of the payload. And then with the "over flap", envelop the payload to protect against outside elements. It has a carrying handle as well as a shoulder strap for easy of transporting the bag.

Without being bound to any theory, existing "cinch" bags are limited to what most refer to as stuff sacks. Most cinch or compression bags, they are limited to the user stuffing goods into them but once in, the goods still try to expand back to their original size thus making the process cumbersome and inefficient. The present disclosure involves cinching through the use of the pull straps compressing the goods down. This also eliminates the hassle of the user having to stuff soft goods into a bag. The pressure points where the straps are sewn allow as much compression as possible. The offset "T" shape contributes to cinching ability, in some embodiments.

It will be appreciated that certain embodiments (e.g., products, kits, method, etc.) may include, incorporate, or otherwise comprise features (e.g., properties, components, ingredients, elements, parts, portions, steps, etc.) described in other embodiments disclosed and/or described herein. Accordingly, the various features of one embodiment can be compatible with, combined with, included in, and/or incorporated into other embodiments of the present disclosure. Disclosure of certain features relative to one embodiment of the present disclosure should not be construed as limiting application or inclusion of said features to the specific embodiment. Rather, it will be appreciated that other embodiments can also include said features without necessarily departing from the scope of the present disclosure. Moreover, unless a feature is described as requiring another features in combination therewith, any feature described herein may be combined with any other feature of a same or different embodiment disclosed herein.

The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope. Various alterations and/or modifications and additional applications of the features illustrated herein which would occur to one skilled in the relevant art and having possession of this disclosure, can be made to the illustrated embodiments without departing from the spirit and scope of the invention as defined by the claims, and are to be considered within the scope of this disclosure. While various features and embodiments have been disclosed herein, other features and embodiments are contemplated. For instance, well-known features and embodiments are not described herein in particular detail in order to avoid obscuring aspects of the described embodiments. Such features and embodiments are, however, also contemplated herein. While various aspects and embodiments have been disclosed herein, other aspects and embodiments are contemplated. The various aspects and embodiments disclosed herein are for purposes of illustration and are not intended to be limiting. It is noted that products, processes, compositions, kits, and methods according to certain embodiments of the present invention may include, incorporate, or otherwise comprise properties, features, components, members, and/or elements described in other embodiments described and/or disclosed herein. Thus, reference to a specific feature in relation to one embodiment should not be construed as being limited to applications only within said embodiment. In addition, various embodiments can be combined to form additional embodiments without departing from the scope of the invention or this disclosure.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached invention disclosure for purposes of illustrating the invention, it will be apparent to those skilled in the art that various changes in the products, processes, compositions, kits, and methods disclosed herein may be made without departing from the scope of the invention, which is defined in the appended claims. All changes which come within the meaning and range of equivalency of the claims are to be embraced within their scope. Various modifications that fall within the scope of the appended claims will be apparent to one skilled in the art.

What is claimed is:

1. A bag assembly, comprising:

a flexible bag template, comprising:

a rectangular-shaped storage element formed of a textile material, the storage element comprising a storage panel, a wrapping panel extending from a first side of the storage panel, and an anchor panel extending from an opposing second side of the storage panel, the storage element having:

an upper edge;

a lower edge opposite the upper edge;

a first side edge extending between the upper edge and the lower edge on a first side of the storage element;

an opposing second side edge extending between the upper edge and the lower edge on a second side of the storage element opposite the first side;

an inner surface comprising an inner face of the wrapping panel, an inner face of the storage panel, and an inner face of the anchor panel; and an outer surface opposite the inner surface, the outer surface comprising an outer face of the wrapping panel, an outer face of the storage panel, and an outer face of the anchor panel;

a first connecting element attached to the outer surface of the wrapping panel;

a second connecting element attached to the outer surface of the anchor panel, the second connecting element and the first connecting element being configured for mating to each other, one or more of the first connecting element and the second connecting element comprising a first cinching element configured to reduce a distance between a portion of the wrapping panel and a portion of the anchor panel when the first connecting element and the second connecting element are mated to each other;

a hood element extending from an upper edge of the storage panel, the hood element having:

a lower edge connected to the upper edge of the storage panel;

an upper edge opposite the lower edge;

a first elastic side edge extending between the upper edge of the hood element and the lower edge of the hood element on a first side of the hood element;

an opposing second elastic side edge extending between the upper edge of the hood element and the lower edge of the hood element on a second side of the storage element opposite the first side;

a third connecting element attached to the storage panel; and a fourth connecting element attached to the hood element, the fourth connecting element and the first connecting element being configured for mating to each other, one or more of the third connecting element and the fourth connecting element comprising a second cinching element configured to reduce a distance between a portion of the storage panel and a portion of the hood element when the third connecting element and the fourth connecting element are mated to each other, wherein the bag template is reconfigurable between:

an unfolded configuration in which the storage element is disposed in a substantially flat configuration; and a folded configuration in which:

the storage element is wrapped and optionally cinched around the load of goods, with the first connecting member being connected to the second connecting member; and the hood element envelopes a portion of the wrapped and optionally cinched storage element, with the third connecting member being connected to the second connecting member, and wherein a center line of the storage element extending between the upper edge and the lower edge of the storage element equidistant between the first side edge and second side edge of the storage element is separated by a first distance from a center line of the storage panel extending between the upper edge and the lower edge of the storage panel equidistant between the first side and second side of the storage panel.

2. The bag assembly of claim 1, wherein the first distance is at least 5% of a length between the first side edge of the storage element and the second side edge of the storage element.

3. The bag assembly of claim 1, wherein a first boundary line extending between the upper edge of the storage element adjacent to the first elastic side edge of the hood element and the lower edge of the storage element defines the first side of the storage panel and a boundary line extending between the upper edge of the storage element adjacent to the second elastic side edge of the hood element and the lower edge of the storage element defines the second side of the storage panel.

4. The bag assembly of claim 1, further comprising a first elastic element attached to the hood element to form the first elastic side edge and a second elastic element attached to the hood element to form the second elastic side edge.

5. The bag assembly of claim 1 further comprising a carrying handle connected to the bag template, the handle forming a loop configured for hand-carrying the bag template in the folded configuration.

6. The bag assembly of claim 1, wherein the carrying handle is attached to an outer surface of the hood element.

7. The bag assembly of claim 1, wherein the carrying handle is attached to an outer surface of the storage element.

8. The bag assembly of claim 1 further comprising a carrying strap connectable to the bag template.

9. The bag assembly of claim 1 further comprising a pocket connected to an outer surface of the hood element and/or the outer surface of the storage element.

10. The bag assembly of claim 1 further comprising a pocket connected to the inner surface of the storage element.

11. The bag assembly of claim 1 further comprising a plurality of pockets connected to the inner surface of the storage element.

* * * * *